United States Patent [19]

Kapitonova

[11] 4,289,992

[45] Sep. 15, 1981

[54] MICROWAVE DEVICE

[76] Inventor: Zinaida P. Kapitonova, ulitsa Ostrovityanova, 23, korpus 5, kv. 112, Moscow, U.S.S.R.

[21] Appl. No.: 45,341

[22] Filed: Jun. 4, 1979

[51] Int. Cl.[3] ..... H01J 25/50

[52] U.S. Cl. ..... 315/39.77; 315/37.51; 315/39.75

[58] Field of Search ..... 315/39.51, 39.75, 39.77

[56] References Cited

U.S. PATENT DOCUMENTS

| | | | |
|---|---|---|---|
| 2,821,659 | 1/1958 | Feinstein | 315/39.77 |
| 3,221,204 | 11/1965 | Hant et al. | 315/3.5 |
| 3,221,205 | 11/1965 | Sensiper | 315/3.5 |
| 3,379,926 | 4/1968 | Symes | 315/39.77 X |
| 3,384,783 | 5/1968 | Olson, Jr. | 315/39.65 X |
| 3,441,793 | 4/1969 | Fosse et al. | 315/39.77 X |
| 3,742,293 | 6/1973 | Chavanat et al. | 315/39.65 |
| 3,970,971 | 7/1976 | Mourier | 315/39.51 |
| 3,995,241 | 11/1976 | Mourier | 315/39.51 |

*Primary Examiner*—Saxfield Chatmon, Jr.
*Attorney, Agent, or Firm*—Fleit & Jacobson

[57] ABSTRACT

A microwave device comprises a cathode producing stream of electrons into the space defined by the cathode and electrodynamic or anode system cells connected in parallel with individual band-reject filters via coupling elements. The rejection band of the filters covers the operating frequency or operating frequency range of the micorwave device. The filters are electrically associated with broad-band microwave loads made as shorted transmission line sections with a variable characteristic impedance, whose surface has a microwave absorbing coating. This ensures suppression of the undesired modes on either side of the operating frequency or operating frequency range of the microwave device.

3 Claims, 3 Drawing Figures

MICROWAVE DEVICE

FIELD OF THE INVENTION

The present invention relates to microwave electronics, and more particularly to microwave devices.

The invention can most advantageously be used for generating or amplifying electromagnetic energy in the microwave range in cases where the requirements to the operating frequency (operating frequency range) stability or single-mode operation are stringent. In addition, the invention may find application in radio devices of various types, in which additional requirements are imposed on the level of leakage radiation to provide for electromagnetic compatibility of the radio equipment.

BACKGROUND OF THE INVENTION

One of the most important problems in designing microwave devices is suppression of undesired modes. Their presence in the spectrum of the output RF signal impairs the device characteristics, namely, reduce the operational stability range, decrease its efficiency and gain factor, etc.

At present, to enhance the stability of the operating frequency (operating frequency range), use is made of generating or amplifying microwave devices with means for suppressing undesired modes.

There is known a microwave device (cf. U.S. Pat. No. 3,221,204; Nov. 30, 1965) comprising cavities and additional chambers with microwave absorbers.

The internal dimensions of the chambers are selected such that their operating frequency range is not covered by that of the microwave device.

Also known is a microwave device (cf. U.S. Pat. No. 3,221,205; Nov. 30, 1965) comprising a cathode which emits electrons into the space defined by the cathode and cells of an electrodynamic or anode system. The cells are connected in parallel with individual filters via coupling elements, the filters being electrically associated with microwave absorbers to suppress undesired modes.

The filters in this prior art device are different constructions of transmission line (waveguides, coaxial cables, periodic loaded waveguides).

However, the use of such filters does not provide for simultaneous suppression of the undesired modes on either side of the operating frequency or operating frequency range of the device. Besides, the filters introduce attenuation within the operating frequency range, which results in a lower efficiency of the circuit and the device as a whole.

SUMMARY OF THE INVENTION

It is an object of the present invention to suppress the undesired modes on either side of the operating frequency or operating frequency range of a microwave device, without affecting the efficiency of the latter.

Another object of the invention is to reduce the size of the microwave device.

These objects are attained by providing a microwave device comprising a cathode emitting electrons into the space defined by the cathode and cells of an electrodynamic system. Connected in parallel via coupling elements are individual filters electrically associated with microwave absorbers to suppress undesired modes. According to the invention, the filters are of the band-reject type and have a rejection band covering the operating frequency or operating frequency range of the device, and used as the microwave absorbers are broad-band microwave loads made as shorted transmission line sections with a variable characteristic impedance, whose surface has a microwave absorbing coating, whereby the undesired modes on either side of the operating frequency or operating frequency range of the microwave device are suppressed.

It is expedient that the microwave device be provided with a plurality of band-reject filters and, respectively, a plurality of broad-band microwave loads, each forming part of a cell of the electrodynamic system and, taken together, ensuring full suppression of all undesired modes.

It is also expedient that, in the case of a densely packed electrodynamic structure being used in the microwave device, the band-reject filters be arranged so that the spacing therebetween is less than the lateral dimension of a filter, while the broad-band microwave loads be made as an integral whole and associated with at least some filters, and the absorbing coating cover a transmission line section between the points of connection of adjacent filters.

In the proposed microwave device, as a result of connection of the band-reject filters having a rejection band covering the operating frequency range, together with the broad-band microwave loads featuring the above-mentioned properties, to the electrodynamic system of the device, the boundary of the system's pass-band disappears, the pass bandwidth is narrowed to the operating frequency range of the device, and microwaves of all modes with the exception of the operating ones are suppressed with the aid of the broad-band microwave loads. Therewith, the efficiency of the proposed device is substantially increased.

In the case where there are connected to the electrodynamic system a plurality of identical band-reject filters, the electrical parameters of the device become highly reproducible and the microwave device manufacturing cost goes down. The broad-band microwave loads being integrated into a common load considerably cuts down the size and weight of the device.

BRIEF DESCRIPTION OF THE DRAWINGS

The invention will now be described in greater detail with reference to a specific embodiment thereof, taken in conjunction with the accompanying drawings, wherein.

DETAILED DESCRIPTION OF THE INVENTION

Figure 1:
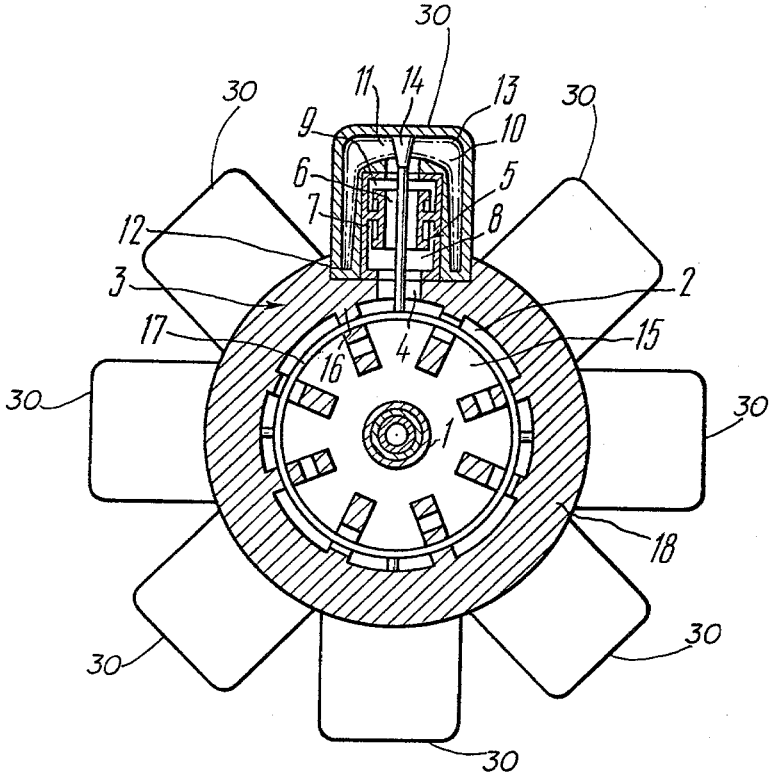
FIG. 1 is a cross-sectional view of a microwave device with a plurality of filters and microwave loads, according to the invention.

Referring now to FIG. 1, the microwave device comprises a cathode 1 which emits electrons into the space defined by the cathode 1 and cells 2 of an electrodynamic or anode system. In this embodiment, the microwave device is a magnetron operating as a generator or an amplifier. Apart from magnetrons, use can be made of other microwave devices, such as Klystrons, travelling-wave tubes, backward-wave tubes, accelerators, etc. Connected in parallel with the cells 2 of the electrodynamic system 3 via coupling elements 4 are filters 5. The filters 5 for suppressing the undesired modes on either side of the operating frequency or operating frequency range of the device are of the band-reject type (hereinafter referred to as band-reject filters 5) and have a rejection band covering the operating frequency or operating frequency range of the microwave device. A band-reject filter 5 comprises a section of a coaxial line 6 with multiply bent cavities 7 at its input 8 and output 9 (cf. USSR Inventor's Certificate No. 268,520; Feb. 3, 1970). The characteristic impedance of individual sections of the cavities 7 and the RF gap between the walls of the cavities 7 vary with the length of the latter. The filters 5 have dimensions commensurate with one quarter of the mean wavelength of the operating frequency range of the microwave device. The microwave device also comprises microwave absorbers electrically associated with the filters 5. The absorbers are essentially broad-band microwave loads 10 made as shorted transmission line sections with a gap narrowing from the input 11 of a load 10 toward its shorted end 12. Applied onto the surface of the shorted sections is a microwave absorbing coating 13, e.g. a fine powder of Al-Si-Fe alloy. The impedances of a load 10 and a filter 5 are matched by means of a transforming transition 14. In the embodiment under consideration, the function of a coupling element 4 is performed by a coaxial line section; however, the filters 5 may be coupled to the cells 2 of the electrodynamic system 3 via waveguide sections, inductance loops or capacitors. The reactance of a coupling element 4 is compensated through selection of the reactive component of the input conductance of a respective filter 5. A cell 2 of the electrodynamic system 3 comprises a resonant cavity 15 confined by fins 16 and a portion of a junction 17. The filters 5 and loads 10 are tightly sealed to an anode assembly 18.

The electrodynamic system 3 incorporates a plurality of band-reject filters 5 when the frequency separation of the desired modes from the undesired ones is sufficiently great or when there are few undesired modes.

FIG. 1 illustrates a microwave device whose electrodynamic system involves a plurality of undesired modes and which comprises a plurality of projecting portions 30 (in this case, eight,) each having a filter 5 and a microwave load 10.

In this case, each filter 5 with a respective load 10 is connected to a different junction 17 and, together, they form part of each cell 2 of the electrodynamic system 3. Power is supplied to and taken from the microwave device, in all embodiments, via leads connected to the electrodynamic system 3 (not shown).

Figure 2:
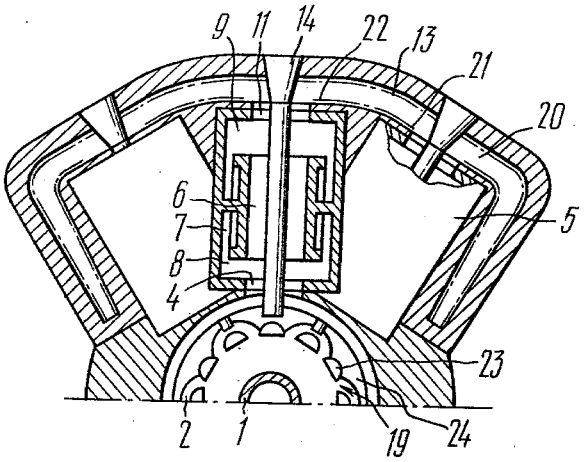
FIG. 2 is a cross-sectional view of a part of the electrodynamic system of a microwave device with filters connected to a common microwave load, according to the invention.

In a microwave device with a densely packed electrodynamic system 19 (FIG. 2), the band-reject filters 5 are so arranged that the spacing therebetween in an azimuthal direction, in this case coinciding with the spacing between adjacent cells 2, is less than the lateral dimension of a filter 5. The microwave loads 20 are made as an integral whole and connected to at least some filters 5. In this embodiment, the common load 20 is connected to three filters 5 in an azimuthal direction and to a plurality of filters 5 in a longitudinal direction. The absorbing coating 13 covers a transmission line section between the points 21 and 22 of connection of adjacent filters 5. The densely packed electrodynamic system 19 comprises conductors 23 forming a multiconductor line shaped as a cylinder and periodically loaded along the microwave device by junctions 24. The junctions 24 have an identical azimuthal configuration and are tuned relative to one another by $2\pi/n$, where n is the number of conductors.

The proposed microwave device operates as follows. A flux of electrons emitted by the cathode 1 (FIG. 1) enters the space defined by the cathode 1 and the cells 2 of the electrodynamic system 3 in which both desired and undesired modes are present.

For suppression of the undesired modes, their loaded Q-factors are reduced, whereby attenuation is introduced into the electrodynamic system 3. To this end, broad-band loads 10 are connected to the cells 2 of the electrodynamic system 3 via band-reject filters 5. The microwave energy on either side of the operating frequency or operating frequency range passes through the filters 5 into the broad-band microwave loads 10 wherein it is absorbed and released in the form of heat. The filters 5 in the operating frequency range feature a high microwave reflection coefficient, and the loads 10 introduce practically no attenuation into the electrodynamic system 3 with the result that the circuit and microwave device efficiencies remain unaffected. The filters 5 also feature a high coefficient of squareness of the amplitude-frequency response, which permits suppressing an undesired mode near the operating frequency range boundary.

In electrodynamic systems 3 with a small number of filters 5, the latter are placed at the maxima of the electromagnetic fields of undesired modes, in which case the filters 5 with the loads 10 perform the function of individual frequency-selective absorbers.

In the case where a plurality of filters 5 are connected to the electrodynamic system 3, they as well as the microwave loads 10 and coupling elements 4 form a part of the electrodynamic system 3, which thus acquires the properties of a band-pass filter of an absorbing type with a passband equal to the operating frequency range of the microwave device.

Figure 3:
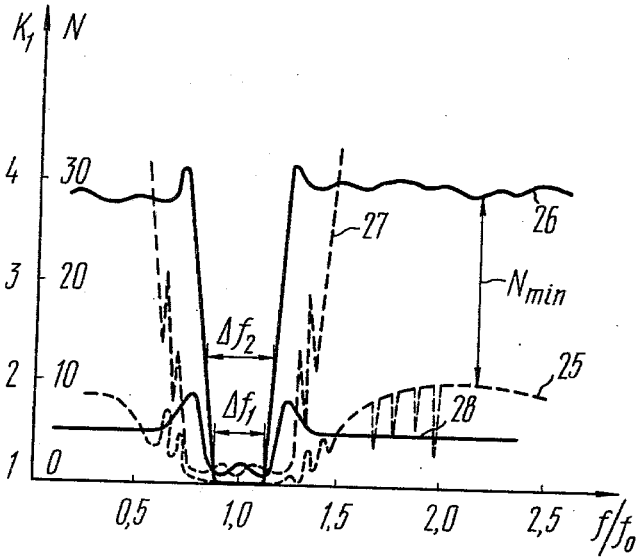
FIG. 3 shows the parameters of the electrodynamic system of the device of FIG. 1 versus frequency, according to the invention.

FIG. 3 represents graphs 25 and 26 showing attenuation N of the electrodynamic system 3 (Y axis) versus frequency f correlated with the operating frequency or the average frequency $f_a$ (X axis) of the operating frequency range. The attenuation N is expressed in decibels and through a ratio of the output to input power: the dashed line, graph 25, stands for attenuation N without filters 5, while the solid line, graph 26, stands for N of the same electrodynamic system 3 with filters 5. The value and nature of the relationship between attenuation N and frequency f are determined by that between the number of band-reject filters 5, their coupling with the electrodynamic system 3 and the loaded Q-factor of a band-reject filter 5.

As an example, FIG. 3 represent the characteristics of the electrodynamic system 3 of an amplifying microwave device, connected whereto are thirty filters 5 with filter 5-to-cell 2 coupling factor less than unity. This factor is defined as the filter 5-to-cell 2 characteristic impedance ratio.

As can be seen from graph 26, the attenuation introduced into the electrodynamic system 3 by the filters 5 is practically nil in the working frequency range. Beyond the operating frequency range, on either side thereof, the attenuation sharply increases.

The coefficient K of squareness of the amplitude-frequency response, which is representative of the properties of the electrodynamic system 3 as a band-pass filter, is determined from the formula:

$K = \Delta f_2 / \Delta f_1$, where $\Delta f_1$ is the frequency band at a level of N=0.4 dB;

$\Delta f_2$ is the transition band at a level of N=10 dB.

In the embodiment under consideration, use is made of filters 5 with a loaded Q-factor of ten, K not exceeding two. The minimum amount $N_{min}$ of the attenuation introduced by the filters 5 in the absorption band exceeds 20 dB.

FIG. 3 also represents graphs 27 and 28 showing voltage standing-wave ratio $K_1$ versus frequency ratio $f/f_a$: the dashed line, graph 27, stands for $K_1$ in the case of an electrodynamic system 3 without filters 5, while the solid line, graph 28, stands for $K_1$ in the case of an electrodynamic system 3 with filters 5. Both graphs 27 and 28 indicate that in the operating frequency range both values of $K_1$ are similar.

The microwave device with a densely packed electrodynamic system 19 (FIG. 19) operates in the following manner.

To suppress undesired modes in a broad frequency band in the electrodynamic system 19 the load 20 performs two functions: that of a resistor matched with the output resistance of the filters 5 in the broad frequency band, and that of a decoupling element between adjacent filters 5. Since the microwave absorbing coating 13 has a limited absorption factor, its area has to be increased or broaden the undesired mode suppression band. This can be achieved by connecting several filters 5 to a common load 20. Thus, one and the same section of the load 20 absorbs microwaves coming from two or more filters 5 and, correspondingly, the active area of the load 20 is reduced, which, in turn, results in the weight and size of the microwave device being cut down.

The proposed microwave device is insensitive to the waveform of the modulating voltage in pulsed operation, features a low level of emissions beyond the operating frequency range in the case of wide variations in the RF load parameters, and is characterized by high durability and reliability in operation.

What is claimed is:

1. A microwave device characterized by an operating frequency range having undesired modes on either side thereof, comprising:

a cathode emitting a stream of electrons;

an anode made up of individual cells receiving and interacting with the stream of electrons;

a coupling element provided in at least one of said cells of said anode;

a plurality of band-reject filters having a rejection band covering the operating frequency range of said microwave device, and each band-reject filter being connected in parallel with respective said at least one of said cells via respective said coupling element; and a plurality of broad-band microwave loads, located outside said anode, comprising shorted transmission line sections and having a variable characteristic impedance;

each respective said coupling element conveying said undesired modes from respective said at least one of said cells to said each band-reject filter, said each band-reject filter discriminating between desired modes and said undesired modes of said device, said plurality of broad-band microwave loads being electrically associated with said band-reject filters and having a microwave absorbing coating for suppressing the undesired modes on either side of said operating frequency range of said microwave device.

2. A microwave device as claimed in claim 1, wherein at least one of said plurality of coupling elements is provided in each said cells, at least one of said plurality of band-reject filters being connected to each said cells, and each of said plurality of broad-band microwave loads being electrically associated with respective said filter, each said filter and each said microwave load forming together part of said cell of said anode and ensuring full suppression of all undesired modes.

3. A microwave device as claimed in claim 2, wherein said anode is densely packed, said plurality of band-reject filters being arranged so that the spacing therebetween is less than the lateral dimension of each said band-reject filter, while said plurality of broad-band microwave loads are made as an integral whole and connected to at least some of said plurality of band-reject filters, and wherein said microwave absorbing coating covers said transmission line section between said points of connection of adjacent said band-reject filters.

* * * * *